US011214889B2

(12) United States Patent
Sato

(10) Patent No.: US 11,214,889 B2
(45) Date of Patent: Jan. 4, 2022

(54) FILM FORMING APPARATUS FOR FORMING METAL FILM

(71) Applicant: TOYOTA JIDOSHA KABUSHIKI KAISHA, Toyota (JP)

(72) Inventor: Yuki Sato, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 64 days.

(21) Appl. No.: 16/816,738

(22) Filed: Mar. 12, 2020

(65) Prior Publication Data

US 2020/0299855 A1 Sep. 24, 2020

(30) Foreign Application Priority Data

Mar. 22, 2019 (JP) ..... JP2019-054747

(51) Int. Cl.

| | |
|---|---|
| ***C25D 17/12*** | (2006.01) |
| ***C25D 17/02*** | (2006.01) |
| ***C25D 7/06*** | (2006.01) |
| ***C25D 17/00*** | (2006.01) |

(52) U.S. Cl.

CPC ..... *C25D 17/12* (2013.01); *C25D 7/0642* (2013.01); *C25D 17/002* (2013.01); *C25D 17/005* (2013.01); *C25D 17/02* (2013.01)

(58) Field of Classification Search

None

See application file for complete search history.

(56) References Cited

U.S. PATENT DOCUMENTS

2004/0065543 A1* 4/2004 Kovarsky ..... C25D 7/12 204/245
2008/0217182 A1* 9/2008 Dai ..... C25D 5/02 205/93
2017/0335479 A1* 11/2017 Sato ..... C25D 17/005

FOREIGN PATENT DOCUMENTS

JP 2014-051701 A 3/2014
JP 2017-088918 A 5/2017

* cited by examiner

*Primary Examiner* — Louis J Rufo
(74) *Attorney, Agent, or Firm* — Oliff PLC

(57) ABSTRACT

Provided is a film forming apparatus for forming a metal film, capable of uniformly pressurizing a substrate surface with an electrolyte membrane subjected to the fluid pressure of an electrolytic solution containing metal ions during film formation even when an insoluble anode is used. A housing of the apparatus includes a partition member between the anode and the electrolyte membrane, for partitioning a housing chamber into first and second housing chambers. The partition member includes a porous body impregnated with cation exchange resin. The first housing chamber houses the anode insoluble in a first electrolytic solution. The second housing chamber has formed therein a hermetically sealed space in which a second electrolytic solution containing metal ions is enclosed within the housing, by the electrolyte membrane and the partition member. The apparatus is also provided with a pump (pressure unit) that pressurizes the second electrolytic solution in the second housing chamber.

4 Claims, 2 Drawing Sheets

FILM FORMING APPARATUS FOR FORMING METAL FILM

CROSS REFERENCE TO RELATED APPLICATIONS

The present application claims priority from Japanese patent application JP 2019-054747 filed on Mar. 22, 2019, the entire content of which is hereby incorporated by reference into this application.

BACKGROUND

Technical Field

The present disclosure relates to a film forming apparatus for forming a metal film on a surface of a substrate.

Background Art

Conventionally, film forming techniques for forming a metal film on a surface of a substrate by depositing metal ions thereon is used. For example, JP 2014-051701 A proposes a film forming apparatus for forming a metal film on a surface of a substrate by applying a voltage across an anode and the substrate while pressurizing an electrolyte membrane against the substrate and thus reducing metal ions in the electrolyte membrane.

In such a film forming apparatus, a housing chamber, which houses an electrolytic solution containing metal ions, is provided in contact with the anode and the electrolyte membrane. The electrolyte membrane is attached to a housing, which forms the housing chamber, via an elastic body so as to cover an opening of the housing, and the electrolytic solution is hermetically sealed in the housing chamber.

When a metal film is formed, the substrate is pressurized with the electrolyte membrane with a predetermined pressure while the electrolyte membrane is placed in contact with the substrate so that the elastic body is compressively deformed. Through such compressive deformation of the elastic body, the electrolytic solution in the housing chamber is pressurized and the surface of the substrate is thus pressurized with the electrolyte membrane that is subjected to the fluid pressure of the electrolytic solution. With such a pressurized state maintained, a voltage is applied across the anode and the substrate so that a metal film can be formed on the surface of the substrate.

SUMMARY

However, if an insoluble anode is used as the anode of the film forming apparatus of JP 2014-051701 A, electrolysis of water of the electrolytic solution may occur on the surface of the anode, which in turn may generate oxygen gas on the surface of the anode. Then, the amount of oxygen gas generated may increase with the passage of the film forming time, and the increased oxygen gas may aggregate and accumulate in a predetermined portion on the surface of the anode. Such a phenomenon can occur not only when the electrolytic solution used is an aqueous solution containing metal ions but also when the electrolytic solution used is an electrolytic solution obtained by mixing metal ions in a solvent other than water, such as alcohol, as long as even a slight amount of water is mixed in the electrolytic solution while a film is formed.

As described above, when a metal film is formed, the substrate is pressurized with the electrolyte membrane with the fluid pressure of the electrolytic solution, but if oxygen gas remains in the housing chamber, it may be difficult to uniformly pressurize the surface of the substrate with the electrolyte membrane because the residual oxygen gas has higher compressibility than that of the electrolytic solution. Consequently, it is supposed that a uniform metal film may not be able to be formed.

In view of the foregoing, exemplary embodiments of the present disclosure provide a film forming apparatus for forming a metal film, capable of uniformly pressurizing a surface of a substrate with an electrolyte membrane that is subjected to the fluid pressure of an electrolytic solution containing metal ions while the metal film is formed, even when an anode that is insoluble in the electrolytic solution is used.

Accordingly, a film forming apparatus for forming a metal film according to the present disclosure is a film forming apparatus including at least an anode, an electrolyte membrane disposed between the anode and a substrate, the substrate serving as a cathode, a housing having formed therein a housing chamber that houses an electrolytic solution so that the electrolytic solution contacts the anode and the electrolyte membrane, and a power supply unit adapted to apply a voltage across the anode and the substrate, in which a voltage is applied across the anode and the substrate while the electrolyte membrane is pressurized against the substrate so that metal ions contained in the electrolyte membrane are (chemically) reduced on a surface of the substrate and a metal film is thus formed on the surface of the substrate, the electrolyte membrane is attached to the housing so as to cover an opening of the housing communicating with the housing chamber, the housing has disposed therein a partition member between the anode and the electrolyte membrane, the partition member being adapted to partition the housing into a first housing chamber on the side of the anode that houses a first electrolytic solution as the electrolytic solution and a second housing chamber on the side of the electrolyte membrane that houses a second electrolytic solution as the electrolytic solution, the partition member includes a porous body impregnated with cation exchange resin, the first housing chamber houses as the anode an anode that is insoluble in the first electrolytic solution, the second housing chamber has formed therein a hermetically sealed space in which the second electrolytic solution containing the metal ions is hermetically sealed as the electrolytic solution within the housing, by the electrolyte membrane and the partition member, and the film forming apparatus is provided with a pressure unit adapted to pressurize the second electrolytic solution housed in the second housing chamber.

According to the present disclosure, when a voltage is applied across the anode and the substrate while the substrate is pressurized with the electrolyte membrane, metal ions contained in the electrolyte membrane are reduced on the surface of the substrate. Accordingly, a metal film is formed on the surface of the substrate. In the present disclosure, the partition member is disposed between the anode and the electrolyte membrane, and the partition member includes a porous body impregnated with cation exchange resin. Therefore, formation of an electric field in a region of from the anode to the substrate is not hindered even when a voltage is applied across the anode and the substrate within the housing chamber.

Herein, since the film forming apparatus of the present disclosure uses an anode that is insoluble in the first electrolytic solution, water contained in the first electrolytic solution housed in the first housing chamber may possibly be electrically decomposed while a film is formed, which in turn may generate oxygen gas. However, since the first electrolytic solution and the second electrolytic solution are separated by the partition member in the housing chamber, and the second housing chamber has formed therein a hermetically sealed space in which the second electrolytic solution is enclosed, there is no possibility that the oxygen gas from the anode will be mixed into the second electrolytic solution. Thus, the second electrolytic solution in the second housing chamber can be pressurized by the pressure unit. Accordingly, the surface of the substrate can be uniformly pressurized with the electrolyte membrane that is subjected to the fluid pressure of the second electrolytic solution housed in the second housing chamber.

Further, although hydrogen ions in the first housing chamber increase due to the electrical decomposition of water, such hydrogen ions will pass through the cation exchange resin of the partition member and move to the second housing chamber. Therefore, there is no possibility that excessive hydrogen ions may gather around the anode. Therefore, the voltage applied across the anode and the substrate is stable.

In this manner, even when an anode that is insoluble in the first electrolytic solution is used, it is possible to stabilize a voltage applied across the anode and the substrate while maintaining the state in which the substrate is uniformly pressurized with the electrolyte membrane during formation of a metal film. Accordingly, metal ions contained in the second electrolytic solution in the second housing chamber can be reduced on the surface of the substrate, and a uniform metal film can thus be formed on the surface of the substrate.

Herein, the first housing chamber may be formed of a hermetically sealed space in which the first electrolytic solution is enclosed as long as, even when gas generated on the anode has accumulated in the first housing chamber, the accumulated gas does not inhibit the formation of a metal film. However, in some embodiments, the first housing chamber is open to the outside of the film forming apparatus. According to such embodiments, even when oxygen gas is generated from the anode while a film is formed, the generated oxygen gas can be discharged to the outside of the film forming apparatus.

According to the present disclosure, even when an insoluble anode is used as the anode, a surface of a substrate can be uniformly pressurized with an electrolyte membrane that is subjected to the fluid pressure of an electrolytic solution containing metal ions while a film is formed.

DETAILED DESCRIPTION

Hereinafter, film forming apparatuses for forming metal films according to the first and second embodiments of the present disclosure will be described with reference to FIGS. 1 to 4.

First Embodiment

1. Regarding a Film Forming Apparatus 1

Figure 1:
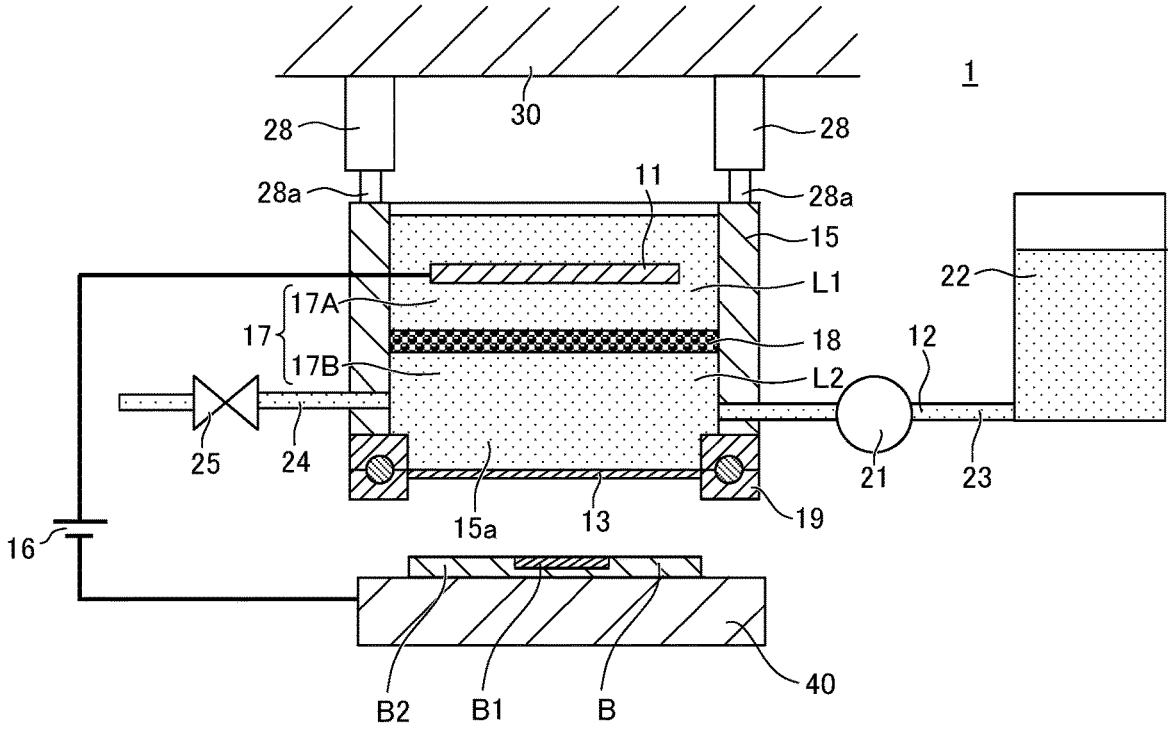
FIG. 1 is a schematic cross-sectional view of a film forming apparatus for forming a metal film according to a first embodiment of the present disclosure.

FIG. 1 is a schematic cross-sectional view of a film forming apparatus 1 for forming a metal film according to the first embodiment of the present disclosure. As illustrated in FIG. 1, the film forming apparatus 1 according to the present disclosure is an apparatus for depositing metal by reducing metal ions and thus forming a metal film of the deposited metal on a surface of a substrate B.

The substrate B on which a metal film is formed is not particularly limited as long as its surface on which the film is formed functions as a cathode (i.e., an electrically conductive surface). Specifically, in the present embodiment, the substrate B is obtained by partially forming an electrically conductive portion B1, such as copper, nickel, silver, or iron, as a cathode on an insulating portion B2, such as polymer resin like epoxy resin, or ceramic. The substrate B may also contain a metallic material, such as aluminum or iron.

The film forming apparatus 1 includes an anode 11 made of metal, an electrolyte membrane 13 disposed between the anode 11 and the substrate B (i.e., the cathode), a housing 15 that houses first and second electrolytic solutions L1 and L2 as electrolytic solutions, and a power supply unit 16 that applies a voltage across the anode 11 and the substrate B.

The film forming apparatus 1 includes a mount base 40 made of metal on which the substrate B is adapted to be placed. A negative electrode of the power supply unit 16 is coupled to the mount base 40, and a positive electrode of the power supply unit 16 is coupled to the anode 11. It should be noted that the mount base 40 is electrically coupled to the electrically conductive portion B1 of the substrate B on which a film is to be formed. This allows the surface of the substrate B to function as a cathode.

The anode 11 is a block-like or plate-like anode and is insoluble in (i.e., does not dissolve in) the first electrolytic solution L1 described below. Examples of such anode include ruthenium oxide, platinum, and iridium oxide that are insoluble in the first electrolytic solution L1. The anode 11 may also be a substrate made of copper or titanium that is covered with such metal.

The electrolyte membrane 13 is not particularly limited as long as it can be impregnated with metal ions when contacting the second electrolytic solution L2 containing the metal ions described below and metal derived from the metal ions can be deposited on the surface of the substrate B upon application of a voltage. Examples of the material of the electrolyte membrane 13 include fluorine-based resin, such as Nafion (registered trademark) produced by DuPont, hydrocarbon-based resin, polyamic acid resin, and resin with a cation exchange function, such as SELEMION (CMV, CMD, CMF series) produced by AGC Inc.

The first electrolytic solution L1 is an electrolytic solution housed in a first housing chamber 17A described below, and the second electrolytic solution L2 is an electrolytic solution housed in a second housing chamber 17B described below. Such electrolytic solutions L1 and L2 are electrically conductive liquids. When a voltage is applied across the anode 11 and the substrate B, an electric field for forming a film is formed in the first and second electrolytic solutions L1 and L2 in a region of from the anode 11 to the substrate B. The second electrolytic solution L2 is an electrolytic solution containing at least metal ions, and the metal ions are reduced when a film is formed and thus are deposited as metal of a metal film. The first electrolytic solution L1 may be an electrolytic solution containing such metal ions, but may also be an electrolytic solution containing no metal ions.

In the present embodiment, the second electrolytic solution L2 is an acid solution containing metal ions, and may be an aqueous solution containing metal ions, for example. The first electrolytic solution L1 may be the same electrolytic solution as the second electrolytic solution L2, but may also be an electrolytic solution not containing the metal ions of the second electrolytic solution L2 as described above.

Examples of metal of the metal ions contained in the second electrolytic solution L2 include copper, nickel, silver, and iron, and the second electrolytic solution L2 is an aqueous solution obtained by dissolving (ionizing) such metal in acids, such as nitric acid, phosphoric acid, succinic acid, sulfuric acid, or pyrophosphoric acid. The first electrolytic solution L1 is the same solution as the second electrolytic solution L2, but is, if not containing metal ions, an aqueous solution of nitric acid, phosphoric acid, succinic acid, sulfuric acid, or pyrophosphoric acid, for example.

For example, when metal of a metal film to be formed is nickel, examples of the second electrolytic solution L2 include aqueous solutions of nickel nitrate, nickel phosphate, nickel succinate, nickel sulfate, and nickel pyrophosphate. The first electrolytic solution L1 may be the same aqueous solution as that of the second electrolytic solution L2, or may be an aqueous solution not containing the metal ions of the second electrolytic solution L2 but containing the same acid as that of the second electrolytic solution L2, such as nitric acid, phosphoric acid, succinic acid, sulfuric acid, or pyrophosphoric acid.

The housing 15 has formed therein the housing chamber 17 that houses the first and second electrolytic solutions L1 and L2 such that the first and second electrolytic solutions L1 and L2 are in contact with the anode 11 and the electrolyte membrane 13, respectively. The material of the housing 15 is not particularly limited as long as it is a corrosion-resistant material for housing the first and second electrolytic solutions L1 and L2. For example, metallic materials, such as stainless steel, can be used.

In the present embodiment, the anode 11 is housed within the housing chamber 17, and the electrolyte membrane 13 is attached to the housing 15 so as to cover an opening 15*a* of the housing 15 communicating with the housing chamber 17.

Further, a partition member 18 is disposed between the anode 11 and the electrolyte membrane 13 within the housing 15. By the partition member 18, the housing chamber 17 is partitioned into the first housing chamber 17A on the side of the anode 11 and the second housing chamber 17B on the side of the electrolyte membrane 13. In the present embodiment, the second housing chamber 17B is disposed below the first housing chamber 17A.

The first housing chamber 17A houses the anode 11 together with the first electrolytic solution L1, and the anode 11 is in contact with the first electrolytic solution L1. In the present embodiment, it is acceptable as long as at least an opposed face of the anode 11 that faces the electrolyte membrane 13 is in contact with the first electrolytic solution L1. In the present embodiment, the anode 11 is immersed in the first electrolytic solution L1 as an example of such a configuration.

In the present embodiment, the anode 11 and the partition member 18 are disposed away from each other, and the anode 11 and the partition member 18 are fixed to the housing 15, though not illustrated. The first housing chamber 17A is open to the outside of the film forming apparatus 1. In the present embodiment, the first housing chamber 17A is open upward toward the outside of the film forming apparatus 1.

It should be noted that as described below, a part of the first housing chamber 17A may be open to the outside of the film forming apparatus 1 as long as oxygen gas generated on the anode 11 can be released to the outside from the first housing chamber 17A. Further, even if the oxygen gas accumulates within the first housing chamber 17A, the first housing chamber 17A need not be open to the outside of the film forming apparatus 1 as long as at least metal derived from the metal ions of the second electrolytic solution L2 can be deposited on the surface of the substrate B upon application of a voltage across the anode 11 and the substrate B.

In the second housing chamber 17B, a hermetically sealed space in which the second electrolytic solution L2 containing metal ions is enclosed within the housing 15 is formed by the electrolyte membrane 13 and the partition member 18. It should be noted that the "hermetically sealed space" as referred to herein is a closed space in which the second electrolytic solution L2 can be stably pressurized within the second housing chamber 17B at least while a metal film is formed. Examples of the hermetically sealed space include a space into which the second electrolytic solution L2 is allowed to flow by a pressure regulating valve 25, for example.

The partition member 18 is a porous body impregnated with cation exchange resin. For example, the partition member 18 may include a porous body having formed therein a plurality of voids, which allow the first housing chamber 17A and the second housing chamber 17B to communicate with each other, and cation exchange resin filling the voids of the porous body.

As described above, the second electrolytic solution L2 is enclosed in the second housing chamber 17B that is partitioned by the electrolyte membrane 13 and the partition member 18 within the housing 15. Therefore, although the partition member 18 includes a porous body as a substrate, since the porous body is impregnated with cation resin, the partition member 18 does not allow the first housing chamber 17A and the second housing chamber 17B to communicate with each other. That is, the partition member 18 does not have a function of passing the first and second electrolytic solutions L1 and L2 therethrough. Thus, passing of the first and second electrolytic solutions L1 and L2 between the first and second housing chambers 17A and 17B is blocked.

The porous body is not particularly limited as long as (1) it can pass cations from the first housing chamber 17A to the second housing chamber 17B via cation exchange resin in a state in which the porous body is impregnated with the cation exchange resin, (2) it is not deformed due to the fluid pressure of the second electrolytic solution L2 generated within the second housing chamber 17B (i.e., can withstand the fluid pressure) while a film is formed, and (3) it has corrosion resistance to the first and second electrolytic solutions L1 and L2.

Examples of the material of the porous body include resin material, metallic material, and ceramic material. For example, the porous body may be the one obtained by forming a plurality of voids in an imperforate board made of any of such materials so as to allow the first housing chamber 17A and the second housing chamber 17B to communicate with each other, or allowing any of such materials to foam.

When the porous body is made of a metallic material, the porous body may be foam metal with high corrosion resistance, such as platinum or iridium oxide, or the one obtained by covering foam metal with high corrosion resistance, such as titanium, with platinum or iridium oxide, for example. When the porous body is a resin material, the porous body may be a foam material, such as polytetrafluoroethylene (PTFE) or polyethylene terephthalate (PET), for example. When a foam material is used, a foam material with a porosity of 50 to 95 volume %, a pore size of about 1 to 600 μm, and a thickness of about 0.1 to 50 mm may be used.

The cation exchange resin is not particularly limited as long as it can pass hydrogen ions contained in the first electrolytic solution L1 and cations, such as metal ions for forming a film, which have been added to the first electrolytic solution L1 as appropriate. For example, materials exemplarily illustrated as the material of the electrolyte membrane 13 can be used.

The film forming apparatus 1 is provided with a pump 21 as a pressure unit that pressurizes the second electrolytic solution L2 housed in the second housing chamber 17B. A supply source 22 that supplies the second electrolytic solution L2 is provided upstream of the pump 21. The supply source 22 and the pump 21 are coupled via a supply pipe 23.

In the present embodiment, the pump 21 is adapted to pressurize the second electrolytic solution L2 in the second housing chamber 17B, and is coupled to the second housing chamber 17B such that it communicates therewith. The second housing chamber 17B has coupled thereto a drain pipe 24 that discharges the second electrolytic solution L2 from the second housing chamber 17B, and the drain pipe 24 is provided with the pressure regulating valve 25.

With the pressure regulating valve 25, the fluid pressure in the second housing chamber 17B can be adjusted. It should be noted that an on-off valve may be provided instead of the pressure regulating valve 25 so that the fluid pressure of the second electrolytic solution L2 in the second housing chamber 17B may be controlled with the discharge pressure of the pump 21 while the on-off valve is in the closed position. Further, the drain pipe 24 downstream of the pressure regulating valve 25 is coupled to the supply source 22, though not illustrated. Accordingly, the second electrolytic solution L2 used in the second housing chamber 17B can be returned to the supply source 22 and used again for forming a film.

Although the pump 21 is used for the pressure unit in the present embodiment, a cylinder (not illustrated) and a piston (not illustrated) may be used for the pressure unit instead of the pump 21. Specifically, a cylinder that houses the second electrolytic solution L2 may be coupled to the housing 15 such that the cylinder communicates with the second housing chamber 17B, and the piston in the cylinder may be moved forward and backward so as to increase and decrease the pressure of the second electrolytic solution L2 in the second housing chamber 17B.

Further, in the present embodiment, an elevating device 28 that positions the electrolyte membrane 13 at a predetermined position via the housing 15 is provided. The elevating device 28 is fixed to a fixation unit 30, and the distal end of a movable unit 28*a* that moves up and down is mechanically coupled to the housing 15. When a film is formed, the housing 15 is lowered from the standby position in FIG. 1 to the film forming position in FIG. 2, and the movement of the housing 15 is stopped to allow the electrolyte membrane 13 to contact the substrate B. After a film is formed, the housing 15 is elevated from the film forming position in FIG. 2 to the standby position in FIG. 1 so that the electrolyte membrane 13 is positioned away from the substrate B.

The elevating device 28 may be a hydraulic or pneumatic actuator including a cylinder and a piston, and for example, the elevating device 28 may be an electric actuator that moves up and down by means of a motor. Alternatively, the elevating device 28 may be omitted as long as the position of the electrolyte membrane 13 in the up-and-down direction can be fixed while being in contact with the substrate B during formation of a film.

2. Regarding a Method of Forming a Film using the Film Forming Apparatus 1

Figure 2:
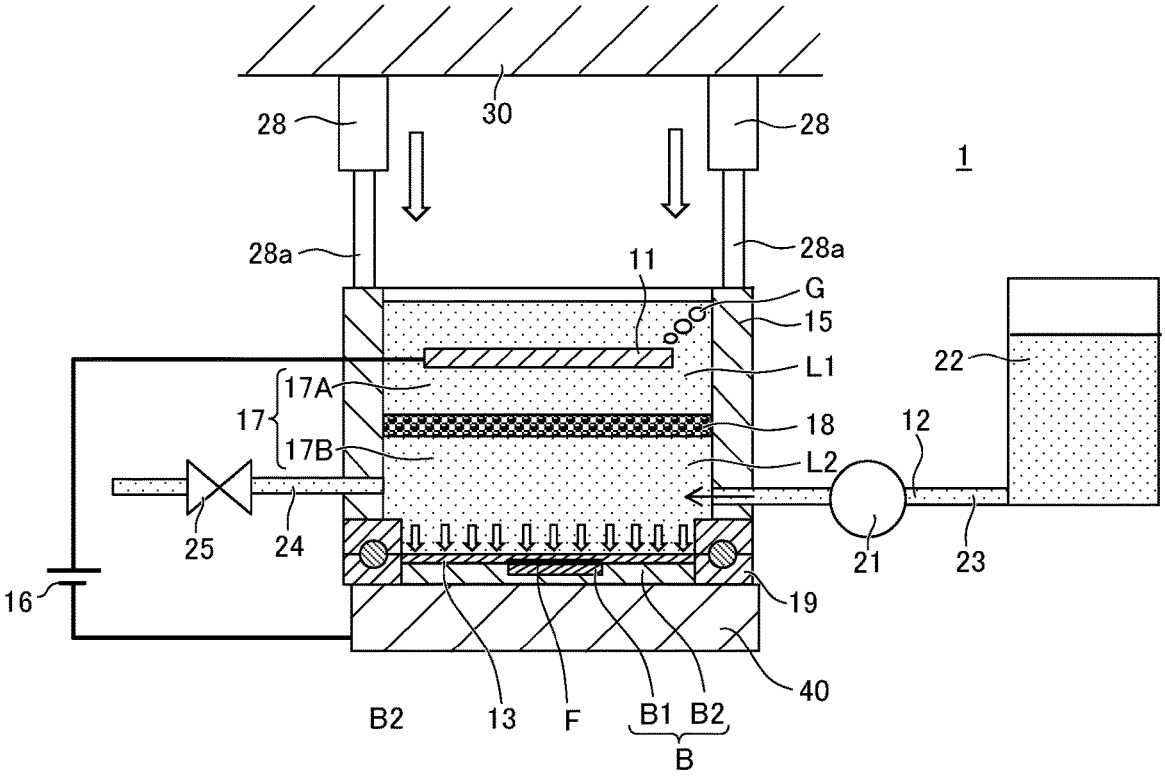
FIG. 2 is a schematic cross-sectional view for illustrating a method of forming a metal film using the film forming apparatus illustrated in FIG. 1.

A method of forming a film using the film forming apparatus 1 according to the present embodiment will be described with reference to FIGS. 1 and 2. FIG. 2 is a schematic cross-sectional view for illustrating a method of forming a metal film F using the film forming apparatus 1 illustrated in FIG. 1.

First, as illustrated in FIG. 1, the substrate B is disposed on the mount base 40 so as to face the electrolyte membrane 13. Next, as illustrated in FIG. 2, the housing 15 is lowered toward the mount base 40 using the elevating device 28 so that the electrolyte membrane 13 contacts the surface of the substrate B.

Next, the pump 21 is driven. In the second housing chamber 17B, the second electrolytic solution L2 containing metal ions is enclosed within the housing 15 by the electrolyte membrane 13 and the partition member 18. Therefore, the second electrolytic solution L2 housed in the second housing chamber 17B is pressurized with the discharge pressure of the pump 21.

Herein, since the film forming apparatus 1 is provided with the pressure regulating valve 25, the pressure in the second housing chamber 17B is increased up to the pressure set by the pressure regulating valve 25. The drive of the pump 21 may be stopped in such a state. However, when the pump 21 is driven continuously, the second electrolytic solution L2 in the supply source 22 is supplied continuously to the second housing chamber 17B so that the second electrolytic solution L2 housed in the second housing chamber 17B can be held at a constant pressure by the pressure regulating valve 25.

As described above, the surface of the substrate B can be uniformly pressurized with the electrolyte membrane 13 that is subjected to the fluid pressure of the second electrolytic solution L2 housed in the second housing chamber 17B. It should be noted that since the second electrolytic solution L2 containing metal ions is in contact with the electrolyte membrane 13, the electrolyte membrane 13 contains the metal ions.

When a voltage is applied across the anode 11 and the substrate B by the power supply unit 16 while the substrate B is pressurized with the electrolyte membrane 13 that is subjected to the fluid pressure of the second electrolytic solution L2, the metal ions contained in the electrolyte membrane 13 are reduced on the surface of the substrate B (specifically, the electrically conductive portion B1). Accordingly, the metal film F is formed on the surface of the substrate B.

Herein, in the present embodiment, the partition member 18, which is disposed between the anode 11 and the electrolyte membrane 13, includes a porous body impregnated with cation exchange resin. Therefore, formation of an electric field in a region of from the anode 11 to the substrate B is not hindered even when a voltage is applied across the anode 11 and the substrate B in the housing chamber 17 by the power supply unit 16.

By the way, since an anode that is insoluble in the first electrolytic solution L1 is used as the anode 11, water contained in the first electrolytic solution L1 housed in the first housing chamber 17A may possibly be electrically decomposed ($2H_2O \rightarrow O_2+4H^+ +4_e^-$), which in turn may generate oxygen gas G.

However, the first electrolytic solution L1 and the second electrolytic solution L2 are separated by the partition member 18 in the chamber 17, and the second housing chamber 17B has formed therein a hermetically sealed space in which the second electrolytic solution L2 is enclosed. Therefore, the second electrolytic solution L2 in the second housing chamber 17B can be pressurized by the pump 21 without the oxygen gas G from the anode 11 being mixed into the second electrolytic solution L2. Accordingly, the surface of the substrate B can be uniformly pressurized with the electrolyte membrane 13 that is subjected to the fluid pressure of the second electrolytic solution L2 housed in the second housing chamber 17B.

Further, since the first housing chamber 17A is open to the outside of the film forming apparatus 1, the generated oxygen gas G is discharged to the outside of the film forming apparatus 1. Although hydrogen ions in the first electrolytic solution L1 housed in the first housing chamber 17A increase due to electrolysis of water, such hydrogen ions will pass through the cation exchange resin of the partition member 18 and move to the second housing chamber 17B. Thus, there is no possibility that excessive hydrogen ions will gather around the anode 11. Consequently, the voltage applied across the anode 11 and the substrate B is stable.

In this manner, even when the anode 11 that is insoluble in the first electrolytic solution L1 is used, it is possible to stabilize the voltage applied across the anode 11 and the substrate B while maintaining the state in which the substrate B is uniformly pressurized with the electrolyte membrane 13 while the metal film F is formed. Accordingly, metal ions contained in the second electrolytic solution L2 in the second housing chamber 17B can be reduced on the surface of the substrate B, and thus, a uniform metal film F can be formed on the surface of the substrate B.

Second Embodiment

3. Regarding a Film Forming Apparatus 1A

A film forming apparatus 1A according to the second embodiment differs from the film forming apparatus 1 according to the first embodiment in the mechanism of pressurizing the second electrolytic solution L2 in the second housing chamber 17B, a mechanism of adjusting the fluid pressure of the second electrolytic solution L2 in the second housing chamber 17B, and the structure of the housing 15. Therefore, members having the same functions as those in the first embodiment are denoted by the same reference numerals, and detailed descriptions thereof will be omitted.

In the film forming apparatus 1 according to the first embodiment, the pump 21 is provided as a pressure unit that pressurizes the second electrolytic solution L2 in the second housing chamber 17B. Meanwhile, in the film forming apparatus 1A according to the present embodiment, a pressure device 21A having a function of moving the housing 15 up and down is provided as a pressure unit that pressurizes the second electrolytic solution L2 in the second housing chamber 17B.

Specifically, the pressure device 21A not only lowers the electrolyte membrane 13 toward the substrate B via the housing 15 to allow the electrolyte membrane 13 to contact the substrate B but also further pressurizes the electrolyte membrane 13 in contact with the substrate B. The pressure device 21A may be either a hydraulic or pneumatic actuator including a cylinder and a piston, and may be, for example, an electric actuator that moves up and down by means of a motor.

Further, in the present embodiment, an elastic body 25A is attached between the housing 15 and the electrolyte membrane 13 so as to surround the circumference of the opening 15*a* of the housing 15 (or the housing body 15A). Specifically, the elastic body 25A is attached between a sealant 19 and the housing 15, and the elastic body 25A is adapted to be compressively deformed by the pressure device 21A.

Examples of the elastic body 25A include compressively deformable rubber or resin, and may be a material that will not degrade due to the second electrolytic solution L2 (for example, an acid-resistant material). Exemplary materials of such an elastic body 25A include silicone rubber.

Further, in the present embodiment, the housing includes a housing body 15A and a cap 15B. The housing body 15A has formed therein the housing chamber 17 as with the housing according to the first embodiment, and the housing chamber 17 is partitioned into the first housing chamber 17A and the second housing chamber 17B by the partition member 18.

The cap 15B is integrally and detachably attached to the housing body 15A so as to cover the opening of the first housing chamber 17A, and the pressure device 21A is attached to the upper face of the cap 15B.

The inner face (i.e., lower face) of the cap 15B partially forms the first housing chamber 17A, and has an inclined plane 15*c* that is inclined toward the rim from the center of the cap 15B. Further, the rim of the cap 15B has formed therein communication holes 15*d* communicating with the outside of the film forming apparatus 1 from the first housing chamber 17A. The first housing chamber 17A is open to the outside of the film forming apparatus 1 through the communication holes 15*d*. It should be noted that a detachable stopper (not illustrated) may be provided in each communication hole 15*d*.

4. Regarding a Method of Forming a Film using the Film Forming Apparatus 1A

Hereinafter, a method of forming a film using the film forming apparatus 1A according to the present embodiment will be described with reference to FIGS. 3 and 4. FIG. 4 is a schematic cross-sectional view for illustrating a method of forming the metal film F using the film forming apparatus 1A illustrated in FIG. 3.

Figure 3:
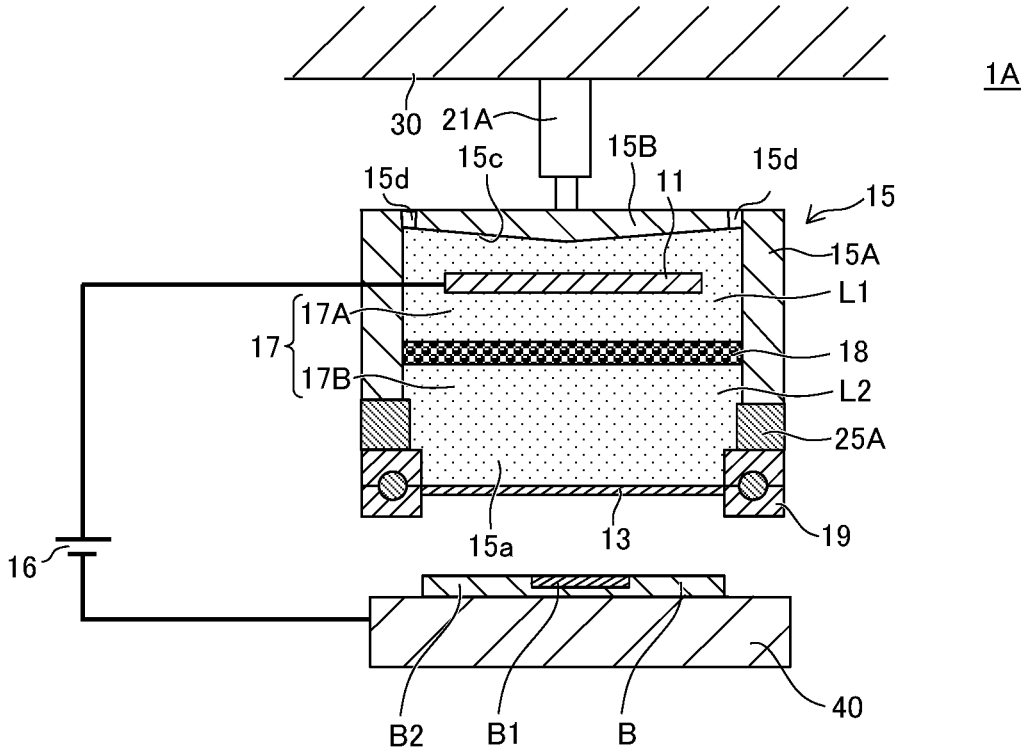
FIG. 3 is a schematic cross-sectional view of a film forming apparatus for forming a metal film according to a second embodiment of the present disclosure.
Figure 4:
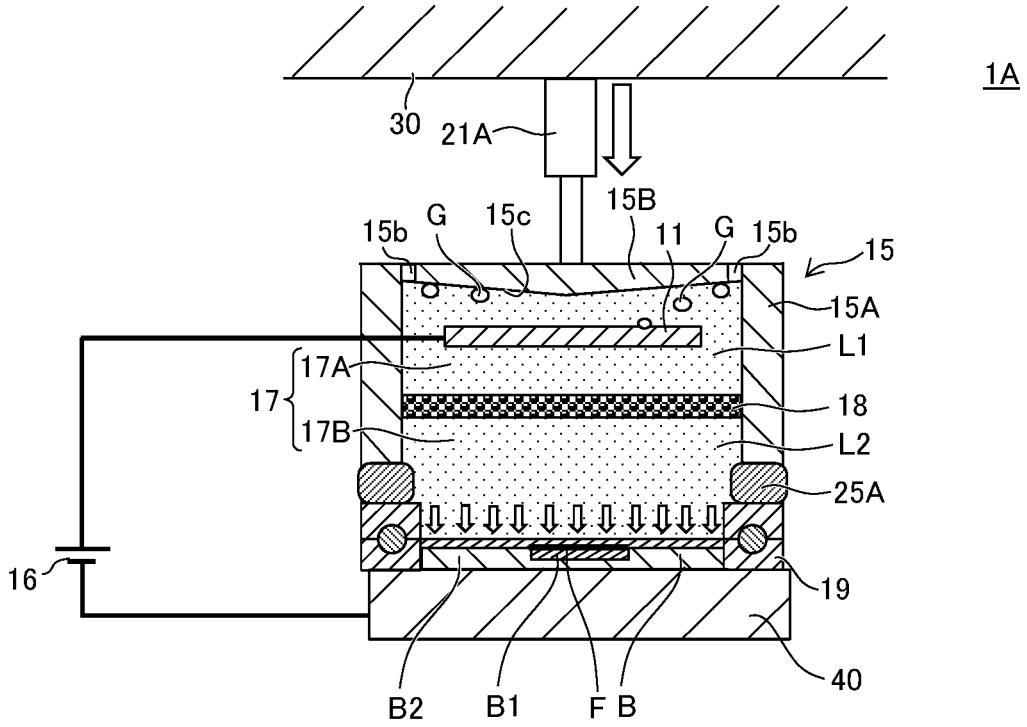
FIG. 4 is a schematic cross-sectional view for illustrating a state in which a metal film is formed using the film forming apparatus illustrated in FIG. 1.

First, as illustrated in FIG. 3, the substrate B is disposed on the mount base 40 so as to face the electrolyte membrane 13. Next, as illustrated in FIG. 4, the housing 15 is lowered toward the mount base 40 using the pressure device 21A to allow the electrolyte membrane 13 to contact the surface of the substrate B.

Next, the substrate B is pressurized with the electrolyte membrane 13 by the pressure device 21A. At this time, the elastic body 25A is compressively deformed in the pressurization direction, and the second electrolytic solution L2 housed in the second housing chamber 17B is pressurized to have a fluid pressure adjusted. In this manner, the surface of the substrate B can be uniformly pressurized with the electrolyte membrane 13 that is subjected to the fluid pressure of the second electrolytic solution L2 housed in the second housing chamber 17B.

Next, when a voltage is applied across the anode 11 and the substrate B by the power supply unit 16 while the substrate is pressurized with the electrolyte membrane 13 that is subjected to the fluid pressure of the second electrolytic solution L2, metal ions contained in the electrolyte membrane 13 are reduced on the surface of the substrate B (specifically, the electrically conductive portion B1). Accordingly, the metal film F is formed on the surface of the substrate B.

In the present embodiment also, water contained in the first electrolytic solution L1 housed in the first housing chamber 17A may possibly be electrically decomposed while a film is formed, which in turn may generate oxygen gas G. However, the oxygen gas G will rise due to buoyancy and flow along the inclined plane 15*c* of the cap 15B, and then be discharged from the communication holes 15*d*.

In this manner, in the present embodiment, it is also possible to stabilize a voltage applied across the anode 11 and the substrate B while maintaining the state in which the substrate B is uniformly pressurized with the electrolyte membrane 13 during formation of the metal film F as in the first embodiment. Accordingly, metal ions contained in the second electrolytic solution L2 in the second housing chamber 17B can be reduced on the surface of the substrate B and a uniform metal film F can thus be formed on the surface of the substrate B.

Although the embodiments of the present disclosure have been described in detail above, the present disclosure is not limited thereto, and various design changes can be made within the spirit and scope of present disclosure recited in the appended claims.

What is claimed is:

1. A film forming apparatus for forming a metal film, comprising at least:

an anode;

an electrolyte membrane between the anode and a substrate, the substrate serving as a cathode;

a housing having a housing chamber that houses a first electrolytic solution that contacts the anode and a second electrolytic solution that contacts the electrolyte membrane; and a power supply, wherein:

the power supply is configured to supply a voltage across the anode and the substrate while the electrolyte membrane is pressurized against the substrate so that metal ions contained in the electrolyte membrane are reduced on a surface of the substrate and a metal film is thus formed on the surface of the substrate, the electrolyte membrane is attached to the housing to cover an opening of the housing communicating with the housing chamber, the housing has a partition member between the anode and the electrolyte membrane, the partition member partitioning the housing into a first housing chamber on a side of the anode that houses the first electrolytic solution and a second housing chamber on a side of the electrolyte membrane that houses the second electrolytic solution, the partition member includes a porous body impregnated with cation exchange resin, the first housing chamber houses the anode, the anode is insoluble in the first electrolytic solution, the first housing chamber comprises an opening to outside of the film forming apparatus to allow gas generated by the anode to rise through the first electrolytic solution and be discharged, the second housing chamber has a hermetically sealed space in which the second electrolytic solution is enclosed within the housing by the electrolyte membrane and the partition member, the second electrolytic solution containing the metal ions, and the film forming apparatus comprises a pressure unit configured to press the electrolyte membrane onto the substrate which also pressurizes the second electrolytic solution in the second housing chamber.

2. The film forming apparatus for forming a metal film according to claim 1, further comprising an actuator that is configured to move the housing toward the substrate to bring the electrolyte membrane into contact with the substrate.

3. The film forming apparatus for forming a metal film according to claim 1, wherein the electrolyte membrane separates the second electrolytic solution from the substrate.

4. A film forming apparatus for forming a metal film, comprising at least:

an anode;

an electrolyte membrane between the anode and a substrate, the substrate serving as a cathode;

a housing having a housing chamber that houses a first electrolytic solution that contacts the anode and a second electrolytic solution that contacts the electrolyte membrane; and a power supply, wherein:

the power supply is configured to supply a voltage across the anode and the substrate while the electrolyte membrane is pressurized against the substrate so that metal ions contained in the electrolyte membrane are reduced on a surface of the substrate and a metal film is thus formed on the surface of the substrate, the electrolyte membrane is attached to the housing to cover an opening of the housing communicating with the housing chamber, the housing has a partition member between the anode and the electrolyte membrane, the partition member partitioning the housing into a first housing chamber on a side of the anode that houses the first electrolytic solution and a second housing chamber on a side of the electrolyte membrane that houses the second electrolytic solution, the partition member includes a porous body impregnated with cation exchange resin, the first housing chamber houses the anode, the anode is insoluble in the first electrolytic solution, the first housing chamber comprises an opening to outside of the film forming apparatus to allow gas generated by the anode to rise through the first electrolytic solution and be discharged, the second housing chamber has a hermetically sealed space in which the second electrolytic solution is enclosed within the housing by the electrolyte membrane and the partition member, the second electrolytic solution containing the metal ions, and the film forming apparatus comprises a pressure unit configured to pressurize the second electrolytic solution in the second housing chamber, and an actuator that is configured to move the housing toward the substrate to bring the electrolyte membrane into contact with the substrate.

* * * * *